US008070015B2

(12) United States Patent
Lee

(10) Patent No.: US 8,070,015 B2
(45) Date of Patent: Dec. 6, 2011

(54) SMALL-SIZED HAND-OPERATED SPRAY PUMP

(75) Inventor: Chung Kee Lee, Seoul (KR)

(73) Assignee: Chong Woo, Ltd., Ichon (KR)

( * ) Notice: Subject to any disclaimer, the term of this patent is extended or adjusted under 35 U.S.C. 154(b) by 645 days.

(21) Appl. No.: 12/300,142

(22) PCT Filed: May 19, 2007

(86) PCT No.: PCT/KR2007/002447

§ 371 (c)(1),
(2), (4) Date: Nov. 10, 2008

(87) PCT Pub. No.: WO2007/136207

PCT Pub. Date: Nov. 29, 2007

(65) Prior Publication Data

US 2009/0206108 A1 Aug. 20, 2009

(30) Foreign Application Priority Data

May 22, 2006 (KR) ..... 10-2006-0045700

(51) Int. Cl.
*B67D 5/06* (2006.01)

(52) U.S. Cl. ..... 222/105; 222/183; 222/321.9

(58) Field of Classification Search .... 222/321.7–321.9, 222/183, 105, 386.5, 321.1
See application file for complete search history.

(56) References Cited

U.S. PATENT DOCUMENTS

| | | | | |
|---|---|---|---|---|
| 5,678,731 | A * | 10/1997 | Okamura et al. | 222/105 |
| 6,412,663 | B1 * | 7/2002 | Adamson et al. | 222/183 |
| 6,619,505 | B1 * | 9/2003 | Decottignies et al. | 222/95 |
| 6,622,892 | B2 * | 9/2003 | Vance | 222/143 |
| 2003/0094464 | A1 * | 5/2003 | Decottignies | 222/105 |
| 2004/0026459 | A1 * | 2/2004 | Clerget | 222/321.9 |

* cited by examiner

*Primary Examiner* — Kevin P Shaver
*Assistant Examiner* — Donnell Long
(74) *Attorney, Agent, or Firm* — Birch, Stewart, Kolasch & Stewart, LLP

(57) ABSTRACT

Disclosed herein is a small-sized hand-operated spray pump. The spray pump includes a spray nozzle (10) for spraying content, a housing (100) constructed in a narrow and long cylindrical structure to allow the content to be vertically moved therethrough, a cap (20) for controlling the operation of the spray nozzle, a container (130) for containing the content, a closure (80), constructed in a symmetrical wing structure, fixed to one side of housing, a shaft (30) vertically movable along the inner surface of the housing, a piston (92) mounted to the shaft while surrounding the lower end of the shaft, a compression spring (90) for providing a restoring force to the shaft at the time of pumping, a ball (120) for opening and closing an inlet port of the housing at the time of pumping, and a case member (70) constructed in a three-stage frame structure.

13 Claims, 5 Drawing Sheets

[Fig. 1]
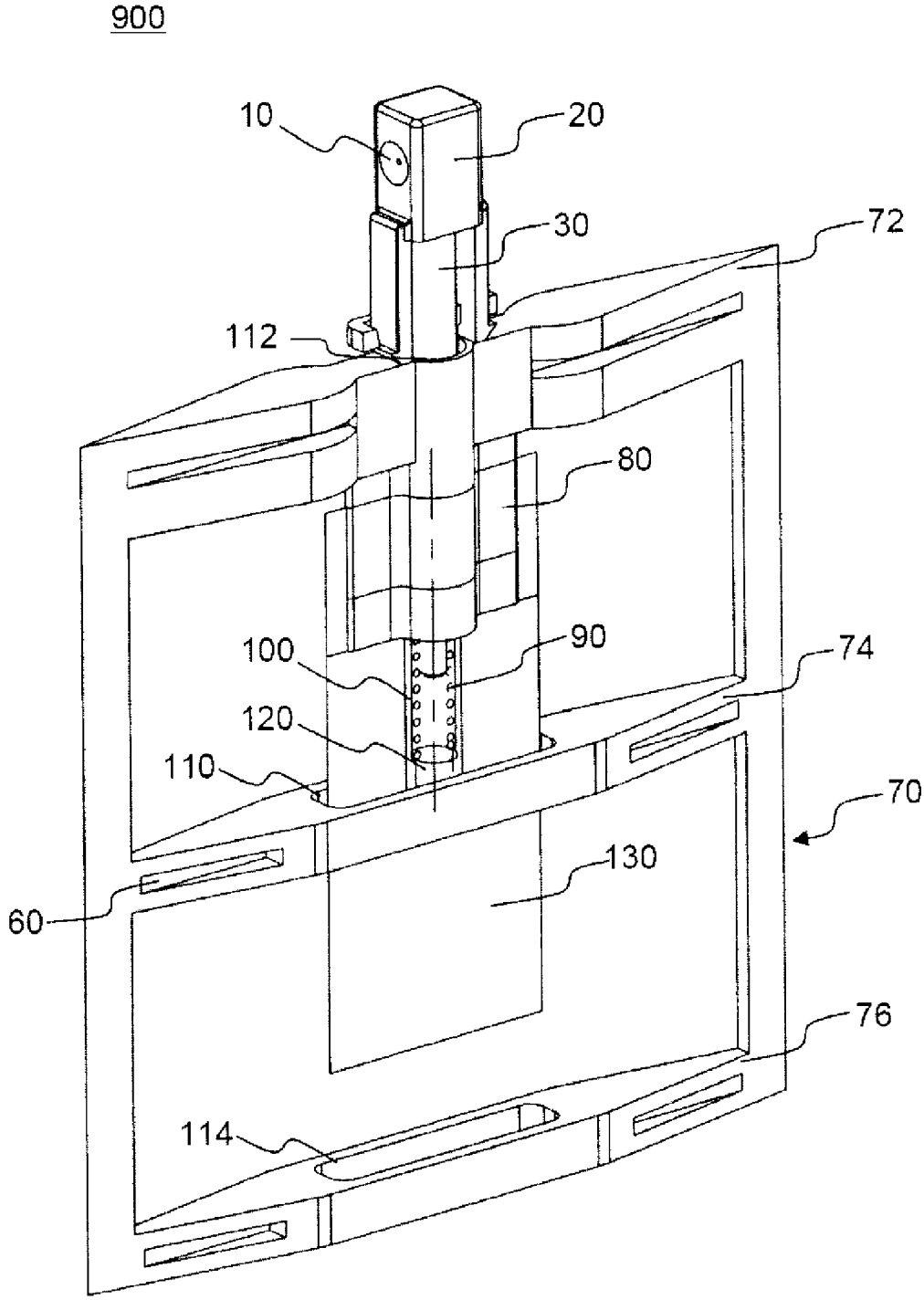

[Fig. 2]
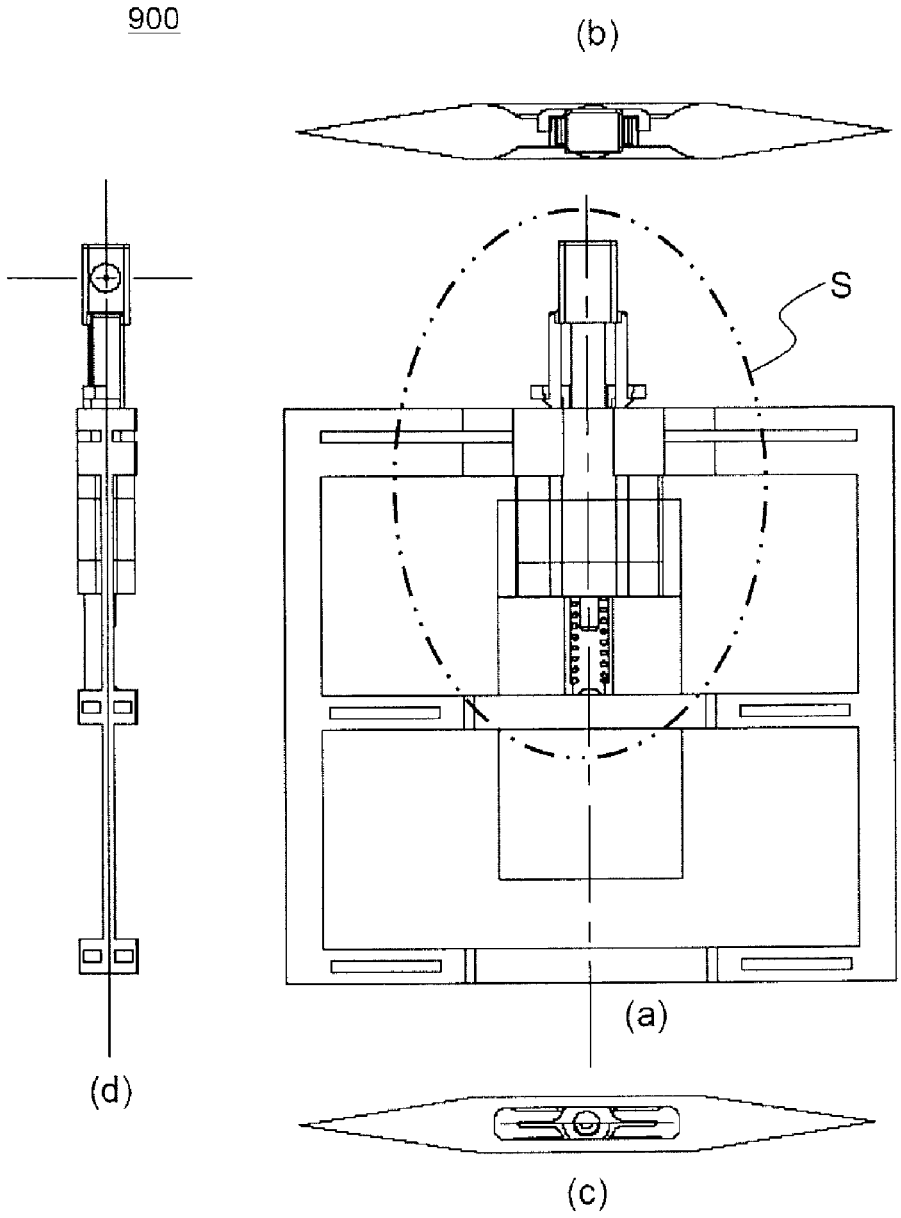

[Fig. 3]
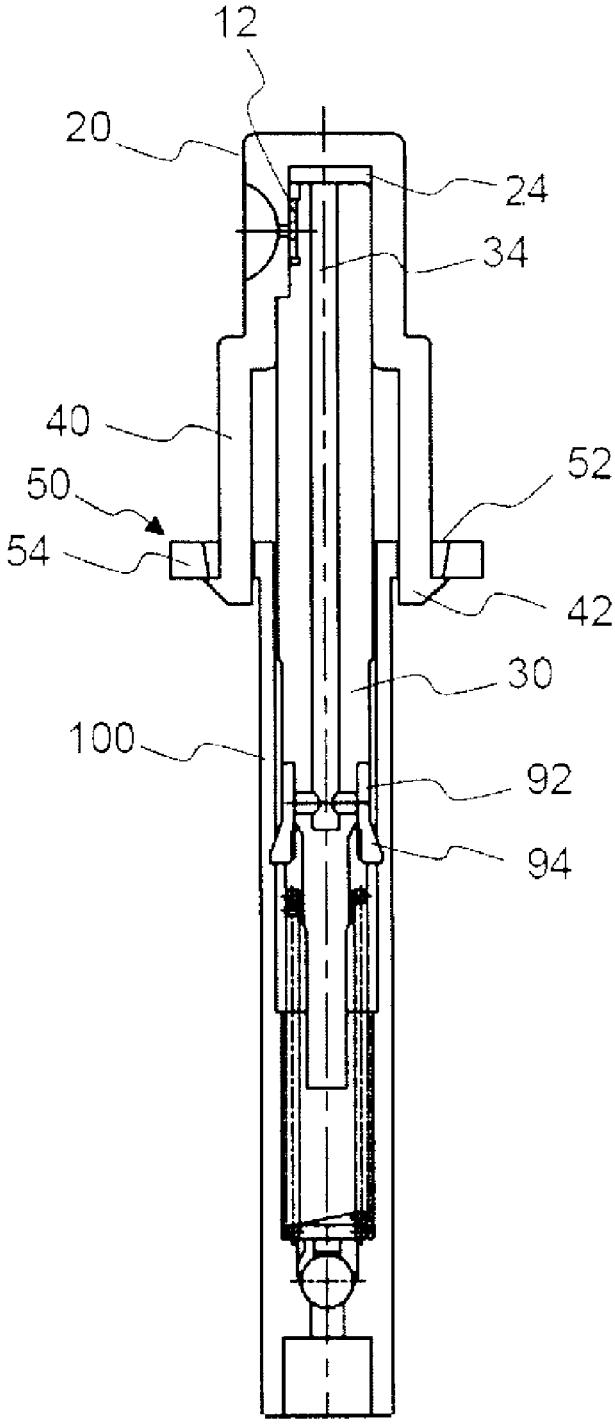

[Fig. 4]
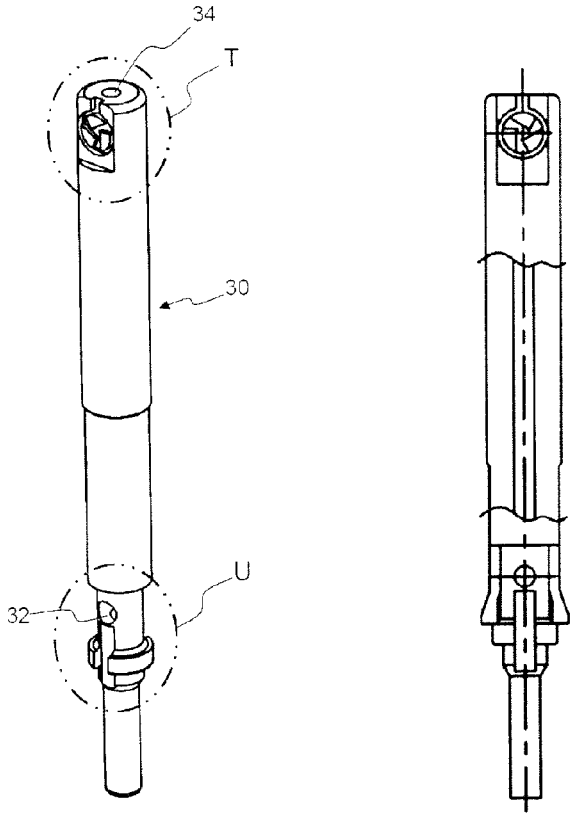
(a) (b)
[Fig. 5]
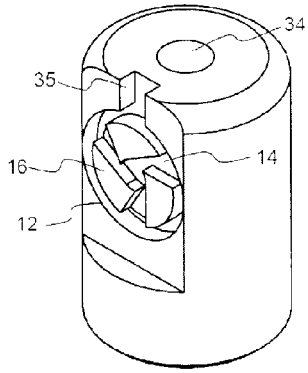
(a)
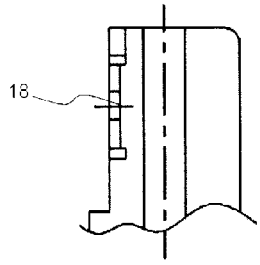
(b)

[Fig. 6]
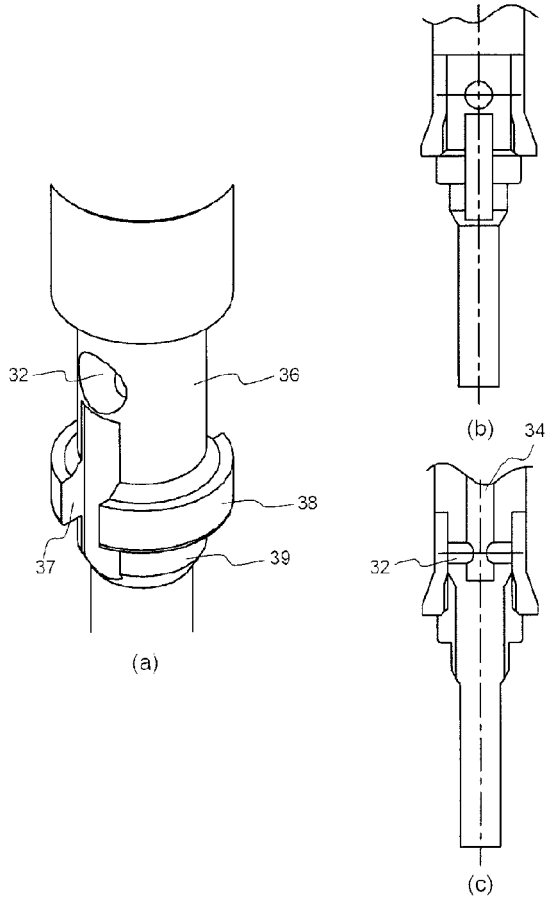
[Fig. 7]
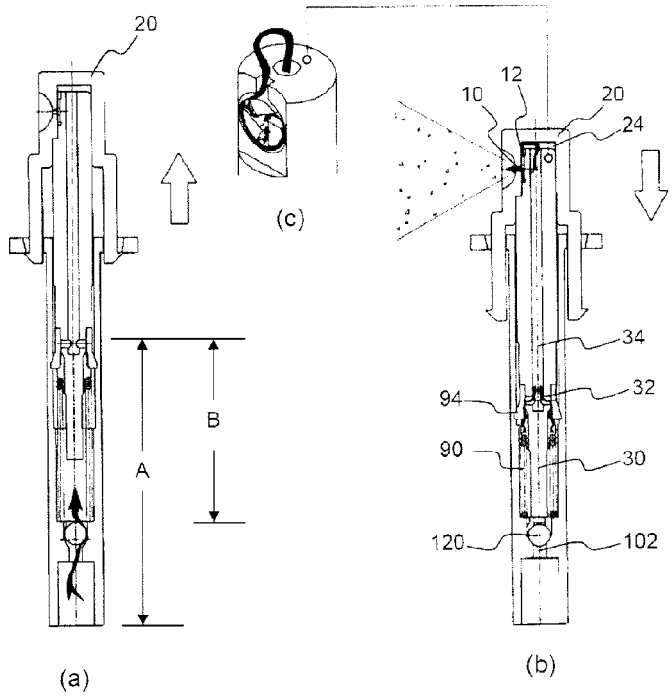

SMALL-SIZED HAND-OPERATED SPRAY PUMP

TECHNICAL FIELD

The present invention relates to a small-sized hand-operated pump, and, more particularly, to a small-sized hand-operated spray pump that can be mounted in a cosmetics container formed in a thin plate shape.

BACKGROUND ART

Generally, a hand-operated pump is classified as a drop-type pump used in shampoo containers or cosmetics containers or as a spray-type pump used in perfume containers or mosquito repellent containers.

Especially, a small-sized hand-operated pump has been normally used in cosmetics containers that discharge a predetermined amount of liquid or emulsion content each time because of its convenience. In this case, the hand-operated pump has been widely used because of its characteristics that a predetermined amount of content can be easily discharged each time by the hand-operated pump while the content is stored in the container, and technologies related to the hand-operated pump have been continuously developed.

Meanwhile, the conventional hand-operated pump mainly includes a housing forming the external appearance of the pump, a closure used to mount the housing to a container, a stem communicating with the outlet port of a cap and vertically movable along the housing, a shaft for guiding the vertical movement of the stem and connecting the stem to the cap, a piston mounted to the stem such that the piston can be vertically moved along the inner wall of the housing, a spring mounted to the inner lower part of the housing, and a ball for opening and closing the inlet port formed in the lower end of the housing.

The conventional hand-operated pump is constructed in a structure in which the hand-operated pump is mounted principally in a cylindrical or prismatic container case. To this end, it is required that the conventional hand-operated pump have a specific width.

Also, the conventional hand-operated spray pump is constructed in a structure having a large thickness and a large volume. As a result, the conventional hand-operated spray pump is not suitable for a small-sized spray pump that is mounted in a perfume container to spray a small amount of perfume.

Recently, as the demand of consumers has abruptly changed, a large number of samples for sales promotion have been provided, and the size of these samples is normally small. For this reason, there is high necessity for a small-sized hand-operated spray pump constructed in a light-weighted and thin structure including a small-sized container.

DISCLOSURE OF INVENTION

Technical Problem

Therefore, the present invention has been made to solve the above problems, and other technical problems that have yet to be resolved.

Specifically, it is an object of the present invention to provide a small-sized hand-operated spray pump that includes a plate-shaped container, such as a thin vinyl pack, without difficulty, can be manufactured wholly in a thin shape and a small size, has a low possibility of breakdown during the use of the spray pump, and is not easily damaged when an external force is applied to the spray pump.

Technical Solution

In accordance with the present invention, the above and other objects can be accomplished by the provision of a small-sized hand-operated spray pump comprising: a cap having a spray nozzle, the cap being coupled to a shaft such that the cap communicates with the upper end of the shaft, the cap being provided at the lower end or side thereof with coupling extensions coupled to the upper end of a housing such that the coupling extensions are vertically reciprocated; the housing constructed in an elongated cylindrical structure forming the external appearance of the pump, the housing being provided at the upper end thereof with a coupling guide, to which the coupling extensions of the cap is coupled; a container mounted at the lower part of the housing, the container being constructed in a plate-shaped structure containing content (fluid); a closure fixed to the outer surface of the housing, the closure being constructed in a symmetrical wing structure in which the upper part of the container is in tight contact with opposite wing parts of the closure; the shaft having a horizontal channel communicating with the inner space of the housing and a vertical channel communicating with the horizontal channel, the shaft being vertically movable along the inner surface of the housing, the shaft being connected to the lower end of the cap; a piston mounted to the shaft for elastically opening and closing the horizontal channel; a compression spring mounted between an inlet port formed in the inner lower part of the housing and the shaft for providing a restoring force to the shaft at the time of pumping; a ball disposed at the inner lower side of the inner space of the housing for opening and closing the inlet port of the housing at the time of pumping; and a case member coupled to the lower part of the coupling guide, the case being constructed in a plate-shaped frame structure including frames protecting the container while the frames are spaced a predetermined distance from the outer circumference of the container.

For example, when cosmetics samples, such as perfume, are provided for the sales promotion of books, the samples are preferably inserted in the books. For this reason, a small-sized hand-operated spray pump having a thin plate-shaped structure is needed. Also, the books may be stacked one on another during the transportation or storage of the books. For this reason, it is necessary for the spray pump to be strong enough not to be damaged when a large load is applied to the spray pump.

Consequently, since the case member, which is constructed in a thin and solid plate-shaped frame structure, is used in the small-sized hand-operated spray pump according to the present invention, it is possible to prevent the breakage of components constituting the pump, such as the housing, due to an external force applied to the pump from top, bottom, or side thereof, to prevent the plate-shaped container containing the content from being pressurized. Especially, the components constituting the pump are safely protected from a strong external force applied to the pump from the side thereof.

Also, the cap is constructed in a simple structure in which the cap is directly coupled to the upper part of the housing. Consequently, the cap is suitable for the structure of the small-sized hand-operated spray pump having a small size and a thin shape, and therefore, it is possible to reduce the manufacturing costs of the small-sized hand-operated spray pump.

In a preferred embodiment, the shaft is provided in the outer surface thereof at a position of the cap corresponding to the nozzle with a fluid distribution port, which is constructed in the form of a radial channel. Consequently, the content contained in the container is discharged through the nozzle such that the content is widely sprayed in a predetermined range. Specifically, although only a small amount of content contained in the container is discharged, the content is widely sprayed over a desired region.

In another preferred embodiment, the shaft is coupled with the cap while the upper end of the shaft is spaced a predetermined distance from the inner upper end of the cap, whereby the vertical channel of the shaft communicates with the fluid distribution port while the shaft is coupled with the cap.

Specifically, when the cap is pressed downward to spray the content, the content contained in the vertical channel of the shaft moves into the gap between the upper end of the shaft and the inner upper end of the cap, and then moves to the fluid distribution port along a groove formed in one side of the upper end of the fluid distribution port.

The conventional hand-operated spray pump is constructed in a structure in which the content contained in the container passes through the horizontal channel and the vertical channel of the shaft, passes through the fluid distribution port, and is then directly sprayed through the nozzle. However, this structure in not suitable for mass production of thin and small-sized hand-operated spray pumps. According to the present invention, on the other hand, the predetermined gap is provided between the upper end of the shaft and the inner upper end of the cap so as to solve the above-mentioned problem.

The fluid distribution port may be constructed in a concave-convex structure in which guide grooves are radially inclined about a region of the cap corresponding to the nozzle such that the content (fluid) is uniformly sprayed with a large radius at the time of pumping.

Specifically, the fluid distribution port is integrally formed at the shaft, and therefore, the small-sized hand-operated spray pump according to the present invention is constructed in a more compact structure. Also, it is possible to solve the problems caused during the assembly process due to the small size of the spray pump. The fluid distribution port may be formed simultaneously, for example, with the manufacture of the shaft.

Preferably, the shaft is provided at the lower part thereof with a piston coupling part, to which the piston is mounted, a spring coupling part, to which the spring is mounted, and a protrusion for preventing the spring from moving to the upper part of the shaft. Consequently, the piston and the spring are stably mounted at the lower part of the shaft.

As previously described, the coupling of the cap to the housing is accomplished by the cooperation between the coupling extensions formed at the outer surface of the cap and the coupling guide formed at the outer surface of the housing.

In a preferred embodiment, the coupling extensions are a pair of members extending from the opposite sides of the lower end of the cap, each coupling extension is provided at the lower end thereof with a coupling wedge, and the coupling guide includes side extensions protruding in opposite directions for guiding the vertical movement of the coupling extensions and through-holes formed in the respective side extensions. In this case, the coupling guide may be formed at the front surface and/or the rear surface of the housing.

The structure of the closure is not particularly restricted so long as the housing and the container are securely coupled with each other by the closure. For example, the closure may be constructed in a structure in which the maximum thickness of the closure not greater than the thickness of a body of the housing, and the thickness of the opposite wing parts of the closure is reduced from the body of the housing to the ends thereof.

The closure may be constructed in a structure in which the opposite wing parts of the closure are symmetrical to each other at the front and rear surfaces thereof. Also, the closure and the housing may be separately or integrally formed depending upon the convenience of the molding and assembly processes.

Preferably, the piston is constructed in a structure in which the outer diameter of the piston, at a region where the horizontal channel of the shaft is closed while the piston is mounted to the shaft, is less than the inner diameter of the housing, the outer diameter of the piston, at the lower end of the piston having an outward tapered structure (incline), is greater than the inner diameter of the housing, and the tapered lower end of the piston is in tight contact with the inner surface of the housing while the tapered lower end is elastically compressed.

In this case, the lower end of the piston is constructed in the tapered incline structure, and therefore, the coupling between the lower end of the piston and the inner surface of the housing is more tightly accomplished. Also, as the tapered lower end of the piston is elastically widened due to the hydraulic pressure generated in the housing at the time of pumping, and therefore, the content moves to the horizontal channel of the shaft through the gap between the lower end of the piston and the shaft.

The structure of the container containing the content is not particularly restricted so long as the container is formed in the shape of a thin plate. For example, the container may be made of a vinyl pack or plastic. Preferably, when the container is used as a small-sized container for containing perfume, the container is made of a transparent material for allowing a user to confirm the content contained in the container from the outside with the naked eye.

The coupling between the container and the closure may be accomplished in various manners. For example, when the container is made of a vinyl pack, the container and the closure may be coupled with each other by a bonding agent so as to maximize the sealability between the container and the closure. When the container is made of plastic, on the other hand, the container and the closure may be coupled with each other by thermal welding so as to maximize the sealability between the container and the closure.

Preferably, the case member is constructed in a three-stage frame structure. Consequently, it is easy to attach and detach the container to and from the case member, and it is possible to prevent an external force from being applied to the container while the content contained in the container is confirmed from the outside.

In a preferred embodiment, the three-stage frame structure includes an upper frame, a middle frame, and a lower frame, the upper frame being provided in the central region thereof with a circular through-hole, through which the housing is vertically inserted, the middle frame or the lower frame being provided in the central region thereof with an elliptical through-hole, through which the container is vertically inserted such that the container is coupled with the middle frame or the lower frame.

Specifically, the housing may be inserted through the circular through-hole formed in the central region of the upper frame such that the housing is mounted in the lower part of the case member, and the container containing the content is inserted sequentially through the elliptical through-hole of the lower frame and the elliptical through-hole of the middle frame such that the container is coupled to the closure of the housing in a sealed state.

Preferably, the case member is constructed in a structure in which the thickness of the case member is reduced from the central part thereof, where the housing is mounted, to the opposite sides thereof. Consequently, it is possible to protect the components constituting the pump, such as the housing, from a load applied to the central part of the case member. Also, while the spray pump according to the present invention is inserted in a book, the side ends of the case member do not protrude outward, and therefore, it is possible to prevent the damage to the book during the storage or handling of the book.

According to circumstances, the respective frames of the three-stage frame structure may be provided in opposite sides about the central regions thereof with elongated grooves, which are arranged horizontally. Consequently, a load generated by an external force applied from the sides of the respective frames may be dispersed to the through-holes. Also, the weight of the respective frames may be reduced by the through-holes.

Advantageous Effects

The small-sized hand-operated spray pump according to the present invention provides several effects. The spray pump according to the present invention is constructed in a compact structure. The operation of the spray pump according to the present invention is stably carried out although the size of the spray pump is greatly reduced. Also, the thickness of the spray pump according to the present invention is very small while the plate-shaped container is mounted to the spray pump. In addition, the components constituting the pump and the container containing the content are effectively protected from an external force by virtue of the frame-structure case member which is located a predetermined distance from the outer circumference of the container. Also, it is possible to see the content from the outside.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view illustrating a small-sized hand-operated spray pump according to a preferred embodiment of the present invention;

FIG. 2A is a front view of the small-sized hand-operated spray pump shown in FIG. 1;

FIG. 2B is a plan view of the small-sized hand-operated spray pump shown in FIG. 1;

FIG. 2C is a bottom view of the small-sized hand-operated spray pump shown in FIG. 1;

FIG. 2D is a left-side view of the small-sized hand-operated spray pump shown in FIG. 1;

FIG. 3 is a partially enlarged sectional view illustrating a region S of FIG. 2A;

FIG. 4A is a partially enlarged perspective view illustrating a shaft region of the small-sized hand-operated spray pump shown in FIG. 1;

FIG. 4B is a vertical sectional view illustrating the shaft region of the small-sized hand-operated spray pump shown in FIG. 1;

FIG. 5A is a partially enlarged perspective view illustrating a fluid distribution port region T of FIG. 4A;

FIG. 5B is a vertical sectional view illustrating the fluid distribution port region T of FIG. 4A;

FIG. 6A is a partially enlarged perspective view illustrating a lower region U of the shaft shown in FIG. 4A;

FIG. 6B is a front view illustrating the lower region U of the shaft shown in FIG. 4A;

FIG. 6C is a side view illustrating the lower region U of the shaft shown in FIG. 4A; and FIGS. 7A to 7C are partial typical views illustrating the operation of the small-sized hand-operated spray pump according to the present invention.

MODE FOR THE INVENTION

Now, a preferred embodiment of the present invention will be described in detail with reference to the accompanying drawings. It should be noted, however, that the scope of the present invention is not limited by the illustrated embodiment.

FIG. 1 is a perspective view typically illustrating a small-sized hand-operated spray pump 900 according to a preferred embodiment of the present invention. FIG. 2A is a front view typically illustrating the small-sized hand-operated spray pump 900 shown in FIG. 1, FIG. 2B is a plan view typically illustrating the small-sized hand-operated spray pump 900 shown in FIG. 1, FIG. 2C is a bottom view typically illustrating the small-sized hand-operated spray pump 900 shown in FIG. 1, and FIG. 2D is a left-side view typically illustrating the small-sized hand-operated spray pump 900 shown in FIG. 1.

Referring to these drawings, the small-sized hand-operated spray pump 900 includes a spray nozzle 10 for spraying content, a housing 100 constructed in a narrow and long cylindrical structure serving as a channel for allowing the content to be vertically moved therethrough, a cap 20 for controlling the operation of the spray nozzle 10, a container 130 for containing the content, a closure 80 fixed to one side of housing 100, the closure 80 being constructed in a symmetrical wing structure, a shaft 30 vertically movable along the inner surface of the housing 100, a piston (not shown) mounted to the shaft 30 while surrounding the lower end of the shaft 30, a compression spring 90 for providing a restoring force to the shaft at the time of pumping, a ball 120 for opening and closing an inlet port of the housing 100 at the time of pumping, and a case member 70 constructed in a three-stage frame structure for protecting the container 130 from an external force.

When the cap 20 is pressed to pump the content out of the container 130, the content, which is introduced into the housing 100 through the inlet port formed in the lower part of the housing 100, passes through a horizontal channel and a vertical channel formed in the lower part of the shaft 30, and is then discharged to the outside through the spray nozzle 10.

The maximum thickness of the closure 80, which is constructed in the symmetrical wing structure, is equal to or less than the thickness of a body of the housing 100. Opposite wing parts of the closure 80, which are symmetrical to each other at the front and rear thereof, are constructed in a structure in which the thickness of the wing parts is reduced from the body of the housing 100 to the ends thereof, whereby the closure 80 is easily coupled to the container 130.

The case member 70 is constructed in the three-stage frame structure, including an upper frame 72, a middle frame 74, and a lower frame 76, to protect the housing 100 and the container 130 from an external force. The upper frame 72 is provided in the central region thereof with a circular through-hole 112, through which the housing 100 is inserted. The middle frame 74 is provided in the central region thereof with an elliptical through-hole 110, through which the container 130 is inserted. Also, the lower frame 76 is provided in the central region thereof with an elliptical through-hole 114, through which the container 130 is inserted.

In opposite sides of the respective frames 72, 74, and 76 are formed elongated grooves, which are arranged horizontally, such that a load generated by an external force applied from the sides of the frames 72, 74, and 76 is dispersed to the through-holes 110, 112, and 114. Also, the weight of the respective frames 72, 74, and 76 is reduced by the through-holes 110, 112, and 114.

FIG. 3 is a partially enlarged sectional view typically illustrating a region S of FIG. 2A.

Referring to FIG. 3, coupling extensions 40 extends by a predetermined length from the opposite sides of the lower end of the cap 20. At the lower end of each coupling extension 40 is formed a coupling wedge 42. A coupling guide 50 includes side extensions 54 protruding horizontally from the upper end of the housing 100 in opposite directions and through-holes 52 formed in the respective side extensions 54. The coupling between the cap 20 and the housing 100 is securely accomplished by the insertion of the coupling wedges 42 of the coupling extensions 40 into the through-holes 52 of the coupling guide 50.

The shaft 30 is coupled with the cap 20 while a gap 24 is provided between the upper end of the shaft 30 and the inner upper end of the cap 20. Consequently, the vertical channel 34 of the shaft 30 communicates with a fluid distribution port 12 via the gap 24.

The lower end of the piston 92 mounted to the lower part of the shaft 30 has an outward tapered incline 94, by which the piston 92 is in tight contact with the inner surface of the housing 100 while the piston 92 is elastically compressed.

FIG. 4A is a partially enlarged perspective view typically illustrating the shaft region of the small-sized hand-operated spray pump shown in FIG. 1, and FIG. 4B is a vertical sectional view typically illustrating the shaft region of the small-sized hand-operated spray pump shown in FIG. 1.

Referring to FIGS. 4A and 4B, the shaft 30 is provided at the lower part thereof with a horizontal channel 32, which communicates with the inner space of the housing 100. The vertical channel 34 of the shaft 30, which perpendicularly communicates with the horizontal channel 32, extends to the upper end of the shaft 30. The shaft 30 is vertically moved along the inner surface of the housing 100.

FIG. 5A is a partially enlarged perspective view typically illustrating a fluid distribution port region T of FIG. 4A, and FIG. 5B is a vertical sectional view typically illustrating the fluid distribution port region T of FIG. 4A.

Referring to FIGS. 5A and 5B, the fluid distribution port 12 is formed in the outer surface of the shaft 30 at a region 18 of the cap corresponding to the nozzle. The fluid distribution port 12 is constructed in the form of a radial channel. Specifically, the fluid distribution port 12 is constructed in a concave-convex structure 16 in which guide grooves 14 are radially inclined about the region 18 of the cap corresponding to the nozzle. A connection groove 35 is formed between the upper end of the shaft and the fluid distribution port 12. Consequently, the content, which passes through the vertical channel 34, is supplied to the fluid distribution port 12 through the connection groove 35 at the time of pumping.

FIG. 6A is a partially enlarged perspective view typically illustrating a lower region U of the shaft shown in FIG. 4A, FIG. 6B is a front view typically illustrating the lower region U of the shaft shown in FIG. 4A, and FIG. 6C is a side view typically illustrating the lower region U of the shaft shown in FIG. 4A.

Referring to FIGS. 6A to 6C, the shaft 30 is provided at the lower part thereof with a piston coupling part 36, to which the piston is mounted, a spring coupling part 39, to which the spring is mounted, and a protrusion 38 for preventing the spring from moving to the upper part of the shaft. At the time of pumping, the content (not shown) contained in the housing passes through depressions 37 formed in opposite sides of the protrusion 38, passes through the horizontal channel 32 of the shaft 30, and then moves to the upper part of the shaft through the vertical channel 34 communicating with the horizontal channel 32.

FIGS. 7A to 7C are partial typical views illustrating the operation of the small-sized hand-operated spray pump according to the present invention. Specifically, FIG. 7A is a typical view illustrating the small-sized hand-operated spray pump before the cap is pressed, FIG. 7B is a typical view illustrating the flow of the content after the cap is pressed, and FIG. 7C is an enlarged typical view illustrating the flow of the content in the fluid distribution port of the shaft.

Referring to these drawings, the content is contained in a section A below the piston and the container (not shown) before the cap 20 is pressed. When the cap 20 is pressed to pump the content out, the shaft 30 is moved downward to compress the compression spring 90, and the ball 120 is pushed due to the hydraulic pressure of the content. As a result, the inlet port 102 of the housing is closed.

At this time, the content contained in a section B pushes the lower end 94 of the piston, by virtue of the hydraulic pressure of the content generated when the cap 20 is pressed, and is introduced into the horizontal channel 32 and the vertical channel 34 of the shaft 30 through the gap therebetween. After that, the content passes through the gap 24 between the upper end of the shaft 30 and the inner upper end of the cap 20, and is uniformly sprayed through the nozzle 10 with a large radius while the content is rotated in the radial guide grooves 14 of the fluid distribution port 12.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

As apparent from the above description, the small-sized hand-operated pump according to the present invention has industrial applicability in that the small-sized hand-operated pump is constructed in a compact structure, and the operation of the small-sized hand-operated pump is stably carried out although the size of the spray pump is greatly reduced.

The invention claimed is:

1. A small-sized hand-operated spray pump comprising:

a cap having an spray nozzle, the cap being coupled to a shaft such that the cap communicates with the upper end of the shaft, the cap being provided at the lower end or side thereof with coupling extensions coupled to the upper end of a housing such that the coupling extensions are vertically reciprocated;

the housing constructed in an elongated cylindrical structure forming the external appearance of the pump, the housing being provided at the upper end thereof with a coupling guide, to which the coupling extensions of the cap is coupled;

a container mounted at the lower part of the housing, the container being constructed in a plate-shaped structure containing content (fluid);

a closure fixed to the outer surface of the housing, the closure being constructed in a symmetrical wing structure in which the upper part of the container is in tight contact with opposite wing parts of the closure;

the shaft having a horizontal channel communicating with the inner space of the housing and a vertical channel communicating with the horizontal channel, the shaft being vertically movable along the inner surface of the housing, the shaft being connected to the lower end of the cap;

a piston mounted to the shaft for elastically opening and closing the horizontal channel;

a compression spring mounted between an inlet port formed in the inner lower part of the housing and the shaft for providing a restoring force to the shaft at the time of pumping;

a ball disposed at the inner lower side of the inner space of the housing for opening and closing the inlet port of the housing at the time of pumping; and a case member coupled to the lower part of the coupling guide, the case being constructed in a plate-shaped frame structure including frames protecting the container while the frames are spaced a predetermined distance from the outer circumference of the container.

2. The spray pump according to claim 1, wherein the shaft is provided in the outer surface thereof at a position of the cap corresponding to the nozzle with a fluid distribution port, which is constructed in the form of a radial channel.

3. The spray pump according to claim 2, wherein the shaft is coupled with the cap while the upper end of the shaft is spaced a predetermined distance from the inner upper end of the cap, whereby the vertical channel of the shaft communicates with the fluid distribution port while the shaft is coupled with the cap.

4. The spray pump according to claim 2, wherein the fluid distribution port is constructed in a concave-convex structure in which guide grooves are radially inclined about a region of the cap corresponding to the nozzle such that the content (fluid) is uniformly sprayed with a large radius at the time of pumping.

5. The spray pump according to claim 1, wherein the shaft is provided at the lower part thereof with a piston coupling part, to which the piston is mounted, a spring coupling part, to which the spring is mounted, and a protrusion for preventing the spring from moving to the upper part of the shaft.

6. The spray pump according to claim 1, wherein the coupling extensions are a pair of members extending from the opposite sides of the lower end of the cap, each coupling extension is provided at the lower end thereof with a coupling wedge, and the coupling guide includes side extensions protruding in opposite directions for guiding the vertical movement of the coupling extensions and through-holes formed in the respective side extensions.

7. The spray pump according to claim 1, wherein the closure is constructed in a structure in which the maximum thickness of the closure not greater than the thickness of a body of the housing, and the thickness of the opposite wing parts of the closure is reduced from the body of the housing to the ends thereof.

8. The spray pump according to claim 1, wherein the piston is constructed in a structure in which the outer diameter of the piston, at a region where the horizontal channel of the shaft is closed while the piston is mounted to the shaft, is less than the inner diameter of the housing, the outer diameter of the piston, at the lower end of the piston having an outward tapered structure (incline), is greater than the inner diameter of the housing, and the tapered lower end of the piston is in tight contact with the inner surface of the housing while the tapered lower end is elastically compressed.

9. The spray pump according to claim 1, wherein the container is made of a plate-shaped vinyl pack or plastic.

10. The spray pump according to claim 1, wherein the case member is constructed in a three-stage frame structure.

11. The spray pump according to claim 10, wherein the three-stage frame structure includes an upper frame, a middle frame, and a lower frame, the upper frame being provided in the central region thereof with a circular through-hole, through which the housing is vertically inserted, the middle frame or the lower frame being provided in the central region thereof with an elliptical through-hole, through which the container is vertically inserted such that the container is coupled with the middle frame or the lower frame.

12. The spray pump according to claim 10, wherein the respective frames of the three-stage frame structure are provided in opposite sides about the central regions thereof with elongated grooves, which are arranged horizontally.

13. The spray pump according to claim 1, wherein the case member is constructed in a structure in which the thickness of the case member is reduced from the central part thereof, where the housing is mounted, to the opposite sides thereof.

* * * * *